US009248348B2

(12) United States Patent
Newman

(10) Patent No.: US 9,248,348 B2
(45) Date of Patent: Feb. 2, 2016

(54) PROTECTIVE COVER FOR MEDICINE BALL AND METHODS OF MAKING THEREOF

(71) Applicant: David Ray Newman, El Cajon, CA (US)

(72) Inventor: David Ray Newman, El Cajon, CA (US)

( * ) Notice: Subject to any disclaimer, the term of this patent is extended or adjusted under 35 U.S.C. 154(b) by 0 days.

(21) Appl. No.: 14/282,377

(22) Filed: May 20, 2014

(65) Prior Publication Data

US 2014/0342859 A1 Nov. 20, 2014

Related U.S. Application Data

(60) Provisional application No. 61/825,233, filed on May 20, 2013.

(51) Int. Cl.

| | |
|---|---|
| ***A63B 37/12*** | (2006.01) |
| ***A63B 45/00*** | (2006.01) |
| ***A63B 65/06*** | (2006.01) |

(52) U.S. Cl.

CPC ..... *A63B 37/12* (2013.01); *A63B 45/00* (2013.01); *A63B 65/06* (2013.01); *A63B 2037/125* (2013.01); *Y10T 29/49947* (2015.01)

(58) Field of Classification Search

CPC ..... A63B 39/06; A63B 39/08; A63B 41/08; A63B 65/06; A63B 2037/125; A63B 45/00; A63B 39/12

See application file for complete search history.

(56) References Cited

U.S. PATENT DOCUMENTS

| | | | | | |
|---|---|---|---|---|---|
| 1,660,378 | A * | 2/1928 | Dieterle | A63B 41/085 | 473/597 |
| 1,669,221 | A * | 5/1928 | Turner | | 473/599 |
| 1,678,830 | A * | 7/1928 | Mason | | 473/599 |
| 1,692,305 | A * | 11/1928 | Jacobus | A63B 41/085 | 473/603 |
| 1,705,096 | A * | 3/1929 | Pierce | | 473/599 |
| 1,853,008 | A * | 4/1932 | Turner | | 473/603 |
| 1,900,544 | A * | 3/1933 | Craig | A63B 41/085 | 473/608 |
| 1,917,534 | A * | 7/1933 | Maynard | | 473/599 |
| 4,065,126 | A * | 12/1977 | Mantz | | 473/462 |
| 4,261,565 | A * | 4/1981 | Massino, Sr. | | 473/598 |
| 4,542,902 | A * | 9/1985 | Massino | | 473/602 |
| 5,035,426 | A * | 7/1991 | Spector | | 473/599 |
| 5,135,222 | A * | 8/1992 | Spector | | 473/576 |
| 5,286,020 | A * | 2/1994 | Caruso | | 473/603 |
| 5,480,144 | A * | 1/1996 | Downing | | 473/599 |
| 5,772,543 | A * | 6/1998 | Paino | | 473/594 |
| 6,053,829 | A * | 4/2000 | Conley | | 473/594 |
| 6,123,632 | A * | 9/2000 | Feeney | A63B 41/08 | 473/596 |
| 6,688,998 | B2 * | 2/2004 | Hergert et al. | | 473/599 |
| 6,712,745 | B1 * | 3/2004 | Lynne | | 482/148 |
| 7,066,852 | B1 * | 6/2006 | Feeney | A63B 41/08 | 473/599 |
| 7,077,769 | B2 * | 7/2006 | Buschfort | | 473/570 |
| 7,485,058 | B1 * | 2/2009 | Payne et al. | | 473/607 |
| 8,272,980 | B1 * | 9/2012 | Johnson | | 473/603 |

(Continued)

*Primary Examiner* — Steven Wong

(74) *Attorney, Agent, or Firm* — Procopio, Cory, Hargreaves & Savitch LLP

(57) ABSTRACT

A removable protective ball cover for a medicine ball is provided to protect an outer surface of the ball from wear and tear, increase the grip of the surface of the ball and maintain the balls' shape and structure. The ball cover may be formed from a durable material with high surface tension formed into a spherical shape with an opening that is used to encapsulate the medicine ball within the ball cover. The opening may be cinched closed by lacing the opening together to substantially, if not completely, cover the medicine ball and create a tight fit around the ball that will not move in relation to the ball. The ball cover may be formed from a series of specially-shaped panels which are triple stitched together with a backing material to prevent breaking of the cover.

6 Claims, 5 Drawing Sheets

(56) References Cited

U.S. PATENT DOCUMENTS

| | | | | |
|---|---|---|---|---|
| 8,413,776 | B1 * | 4/2013 | Huff | 190/109 |
| D683,800 | S * | 6/2013 | Ebio | D21/662 |
| D718,825 | S * | 12/2014 | Ross | D21/662 |
| D725,723 | S * | 3/2015 | Eddie | D21/680 |
| 2005/0170921 | A1 * | 8/2005 | Cronin | 473/598 |
| 2005/0239584 | A1 * | 10/2005 | Willyerd | 473/600 |
| 2006/0205544 | A1 * | 9/2006 | Wyner | A63B 41/00 473/569 |
| 2014/0342859 | A1 * | 11/2014 | Newman | 473/598 |
| 2015/0045191 | A1 * | 2/2015 | Carter | 482/93 |

* cited by examiner

PROTECTIVE COVER FOR MEDICINE BALL AND METHODS OF MAKING THEREOF

CROSS REFERENCE TO RELATED APPLICATIONS

This application claims the benefit of priority to U.S. Provisional Patent Application No. 61/825,233, filed May 20, 2013, and entitled "PROTECTIVE COVER FOR MEDICINE BALL AND METHODS OF MAKING THEREOF," which is incorporated herein by reference.

FIELD OF THE INVENTION

The present invention relates to a cover for a medicine ball, and more specifically to a removable protective cover which substantially encloses the surface of a medicine ball in order to protect the outer surface of the medicine ball from wear and tear and maintain the shape of the ball and the integrity of the ball dynamics.

BACKGROUND OF THE INVENTION

A medicine ball is a weighted ball used in fitness and rehabilitation settings. The medicine ball is generally filled with a weighted filler material and covered with a soft but durable surface material. The medicine ball may be filled with sand, steel balls or some type of substance which will help the medicine ball absorb shock when impacted against a surface with a significant amount of force. As a result, the medicine ball does not typically provide a significant amount of bounce. The medicine ball may be covered with a material such as leather, vinyl or nylon, which is stitched together into panels in order to create the spherical shape of the medicine ball. FIG. 1A illustrates one embodiment of the medicine ball 100, illustrating multiple panels 102 of material stitched together at seams 104 in order to form a spherical-shaped surface. A large opening 106 may be present on one section of the outer surface of the medicine ball 100 where the filler material is added prior to closing, which may be closed using laces 108 that pull either side of the opening together in a lacing pattern.

The medicine ball is used in a variety of fitness and rehabilitation activities which require that the ball be lifted by a user and either dropped or thrown. Due to the significant weight of the ball, the force which the ball absorbs on impact is significant. The impact force often results in the seams 104 between the panels 102 coming apart, as illustrated by the tear 110 in FIG. 1B. If the tears are substantial, the filler material may spill out, effectively deflating the medicine ball and collapsing into a non-spherical shape to the point that it cannot be used. Additionally, if the medicine ball loses its shape or the surface material no longer tightly conforms to the filler material shape within, the medicine ball may become unusable. Repairing the medicine ball to add additional filler material and sew up any tears is time-consuming, expensive and not readily available in the marketplace.

In addition, the surface material of the medicine ball is usually a material which has a natural friction to help a user easily grip and move the heavy ball around without dropping it. Over time, the surface material may wear down and lose its frictional properties, resulting in a smooth surface that is difficult for a user to grip and hold during an activity. Furthermore, the surface material may also be worn down to the point that it also begins to tear or wear thin, making repairs impossible. Since it is prohibitively expensive to to replace the surface material of the medicine ball, the loss of grip from the surface material usually means the medicine ball must be discarded.

Therefore, what is needed is a way to preserve the life of a medicine ball and protect it from excessive wear and tear.

SUMMARY OF THE INVENTION

Embodiments described herein provide a removable protective ball cover for a medicine ball which protects the outer surface of the ball from wear and tear, increases the grip of the surface and helps maintain the shape and integrity of ball dynamics, including its firmness, density and rebound. The ball cover is formed from a durable material with high surface tension formed into a spherical shape with an opening that is used to encapsulate the medicine ball within the ball cover. The opening may be cinched closed by lacing, or securing by other means, the opening together to substantially, if not completely, cover the medicine ball and create a tight fit around the ball that will not move in relation to the ball. The ball cover may be formed from a series of specially-shaped panels which are triple stitched together with a backing material to prevent breaking of the cover.

From this description, in conjunction with other items, the advantages of the said invention will become clear and apparent more so based upon the hereinafter descriptions and claims, which are supported by drawings with numbers relating to parts, wherein are described in the following sections containing the relating numbers.

BRIEF DESCRIPTION OF THE DRAWINGS

The accompanying drawings, which are incorporated in and constitute a part of the specification, illustrate embodiments of the invention and, together with the description, serve to explain the objects, advantages, and principles of the invention. In the drawings.

DETAILED DESCRIPTION OF PREFERRED EMBODIMENTS

After reading this description it will become apparent to one skilled in the art how to implement the invention in various alternative embodiments and alternative applications. However, all the various embodiments of the present invention will not be described herein. It is understood that the embodiments presented here are presented by way of an example only, and not limitation. As such, this detailed description of various alternative embodiments should not be construed to limit the scope or breadth of the present invention as set forth below.

Embodiments described herein provide a removable protective ball cover for a medicine ball which protects the outer surface of the ball from wear and tear, increases the grip of the surface and helps maintain the shape and structure of the ball. The ball cover is formed from a durable material with high surface tension formed into a spherical shape with an opening that is used to encapsulate the medicine ball within the ball cover. The opening may be cinched closed by connecting edges of the opening together by lacing or other means to substantially, if not completely, cover the medicine ball and create a tight fit around the ball that will not move in relation to the ball. The ball cover may be formed from a series of specially-shaped panels which are triple stitched together with a backing material to prevent breaking of the cover.

Figure 1A:
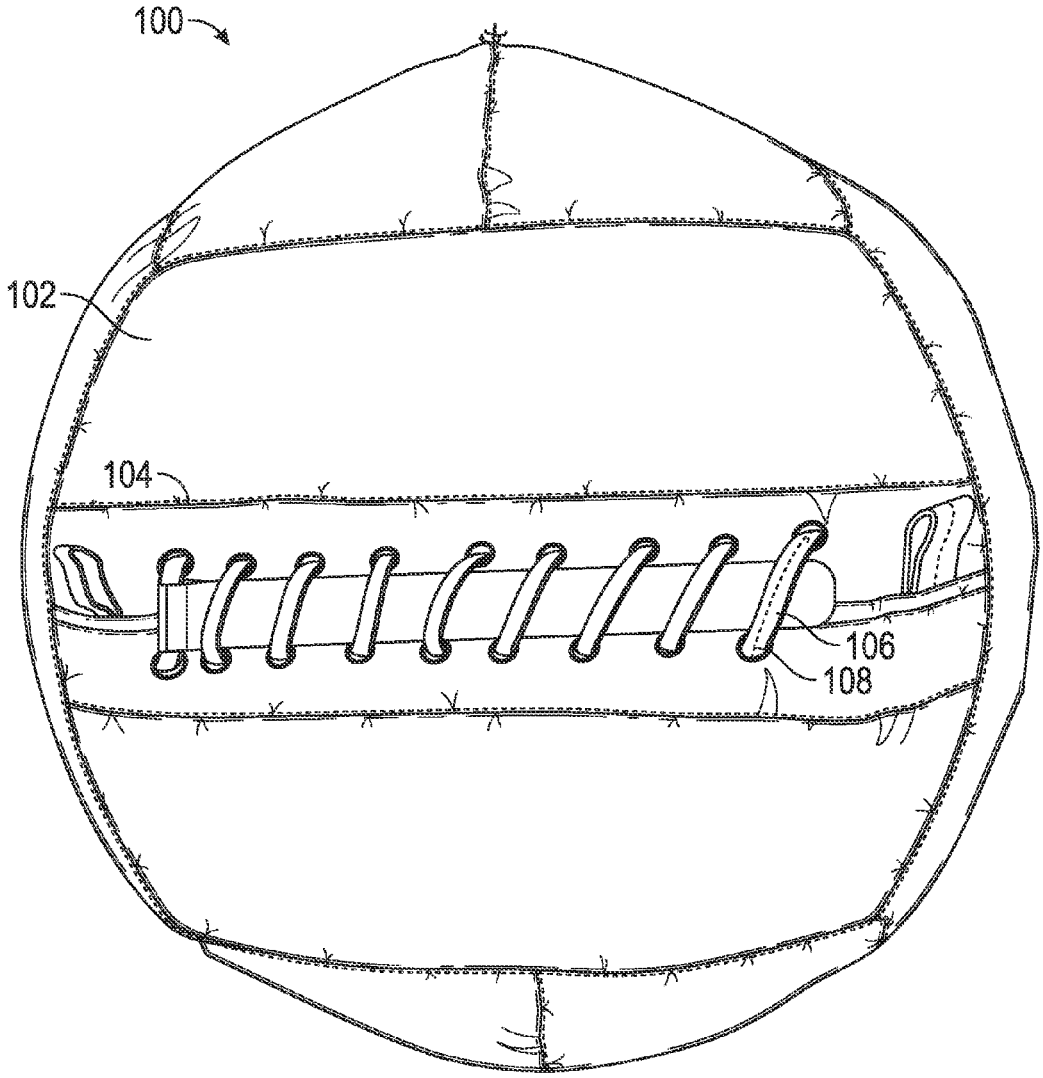
FIG. 1A is an illustration of a medicine ball, according to one embodiment of the invention.
Figure 1B:
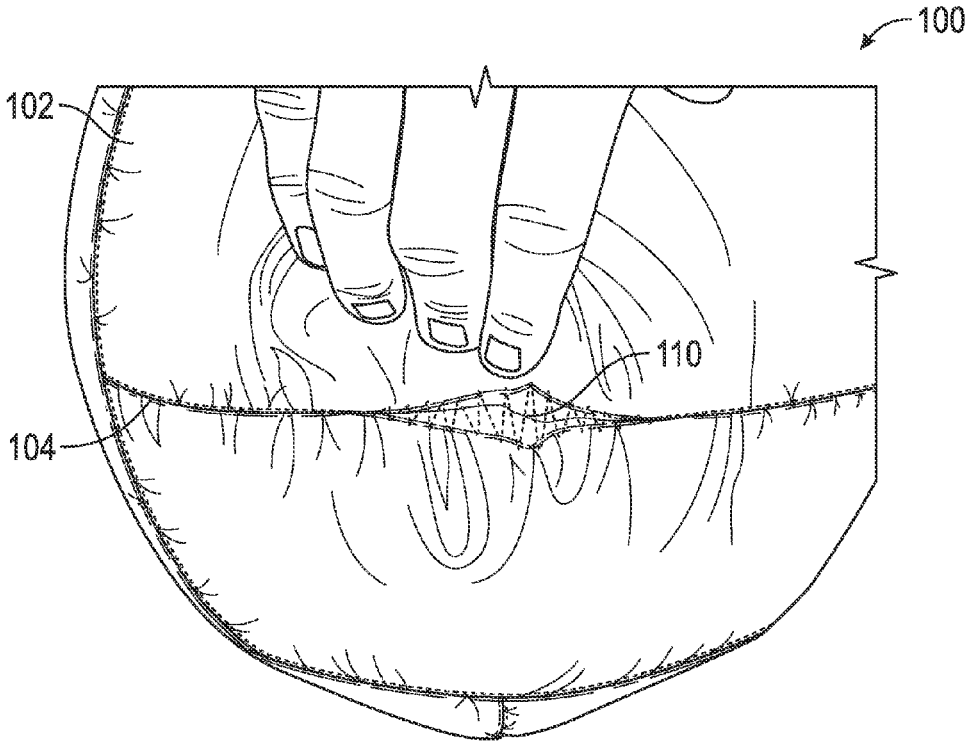
FIG. 1B an illustration of a broken seam of the medicine ball, according to one embodiment of the invention.
Figure 2:
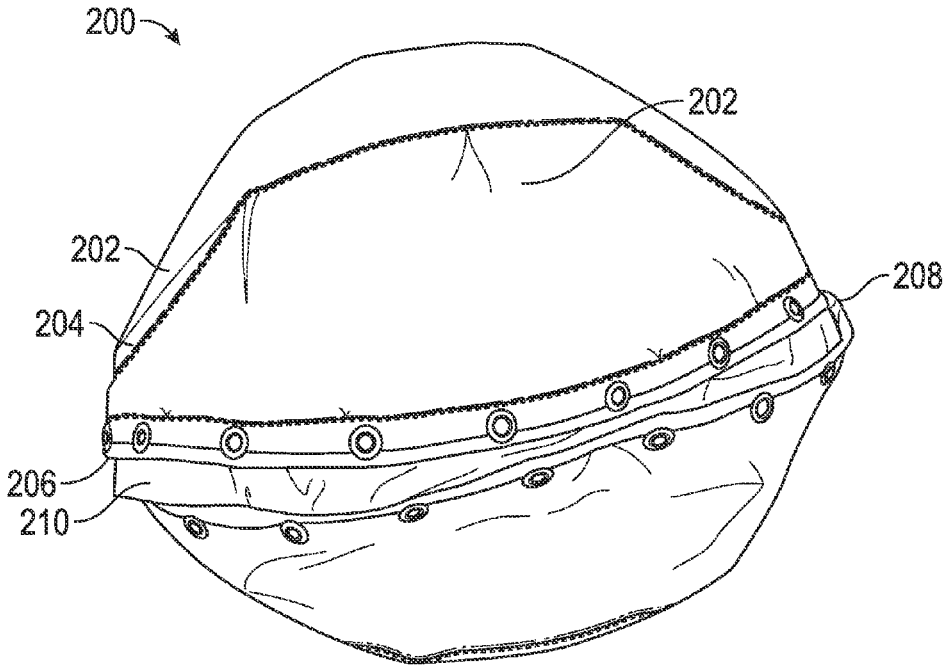
FIG. 2 is an illustration of a medicine ball cover with an opening which can be expanded to substantially enclose a medicine ball, according to one embodiment of the invention.

One embodiment of the protective ball cover 200 is illustrated in FIG. 2. The ball cover 200 is illustrated here on its own as it would appear when not covering the medicine ball. The ball cover 200 is substantially spherical in shape and may be formed from two or more panels 202 of material which are stitched or bonded together at seams 204. In one embodiment, the panels 202 and seams 204 may extend longitudinally from a first pole 206 to a second pole 208. The seams 204 may be disposed at equidistant intervals such that the panels 202 are of equivalent size, although the panels may be of varying shapes and sizes.

The ball cover 200 includes at least one opening 210 which is designed to open wide enough to allow the medicine ball 100 to fit into the ball cover 200. In the embodiment shown in FIG. 2, the opening 210 is disposed longitudinally across the ball cover 200 from the first pole 206 to the second pole 208, allowing the opening to expand significantly during the process of wrapping around the medicine ball, as will be described and illustrated further herein.

Figure 3:
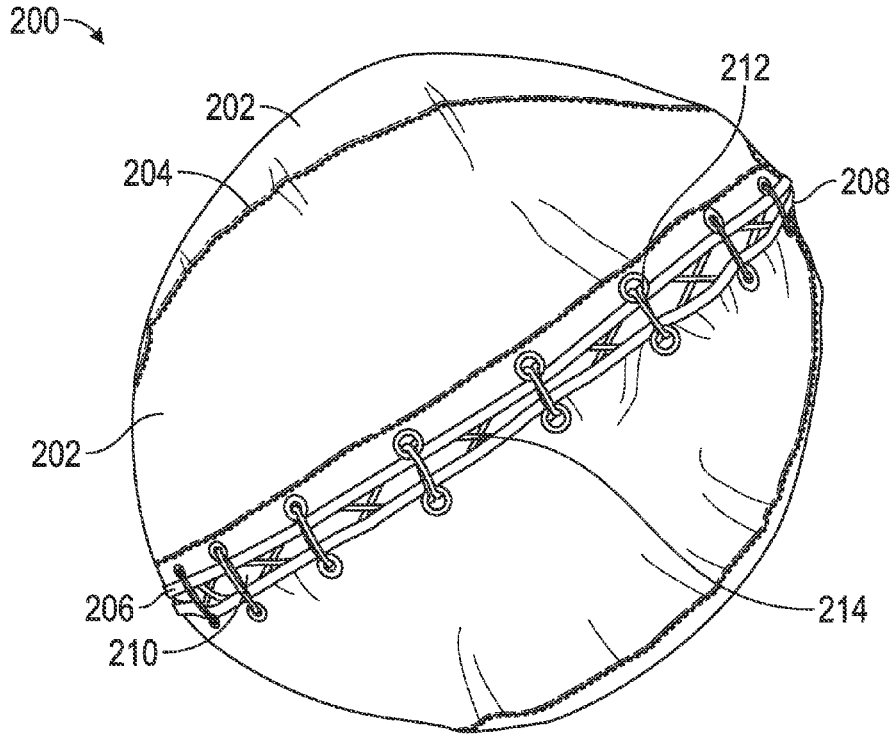
FIG. 3 is an illustration of the medicine ball cover substantially surrounding the medicine ball with the opening cinched closed by a lacing pattern, according to one embodiment of the invention.

The opening 210 may be designed to close around the ball through a closure mechanism in order to tightly cover the medicine ball and protect most, if not all, of the surface of the ball. FIG. 3 illustrates one embodiment of the ball cover 200 with the opening 210 in a closed configuration such that the ball cover completely encloses the ball. In this embodiment, edges of the opening 210 are lined with numerous grommets 212 which can be used with string, rope or lacing 214 to pull the edges of the opening together in order to close the opening 210. The pattern of lacing between the grommets 212 may be designed to tightly close the opening and pull the ball cover into a frictional fit with the ball, such that the ball cover will not move with respect to the ball once the opening is closed. By completely closing the opening around the ball, any damaged surface area of the ball or exposed filler material will be contained within the ball cover. The lacing pattern may also be primarily present on an interior surface of the ball cover in order to minimize wear and tear on the lacing, as illustrated in FIG. 3. The lacing pattern illustrated in FIG. 3 passes diagonally from a grommet on a first edge to an adjacent grommet on a second edge on the interior surface of the ball cover, while also passing on the exterior surface of the ball cover directly from a grommet on the first edge to a grommet on the second edge that is directly across the opening.

Although lacing is illustrated herein, numerous different mechanisms may be used to close the opening of the ball cover, such as Velcro, snaps, magnets, zippers, etc. While the closing mechanism is needed to close the opening, certain closing mechanisms, such as the lacing, may also serve to pull the ball cover more tightly into contact with the ball in order to obtain a tighter fit around the ball. In order to allow the opening to be more tightly closed, the lacing may be made out of a flexible or stretchable material.

Figure 4:
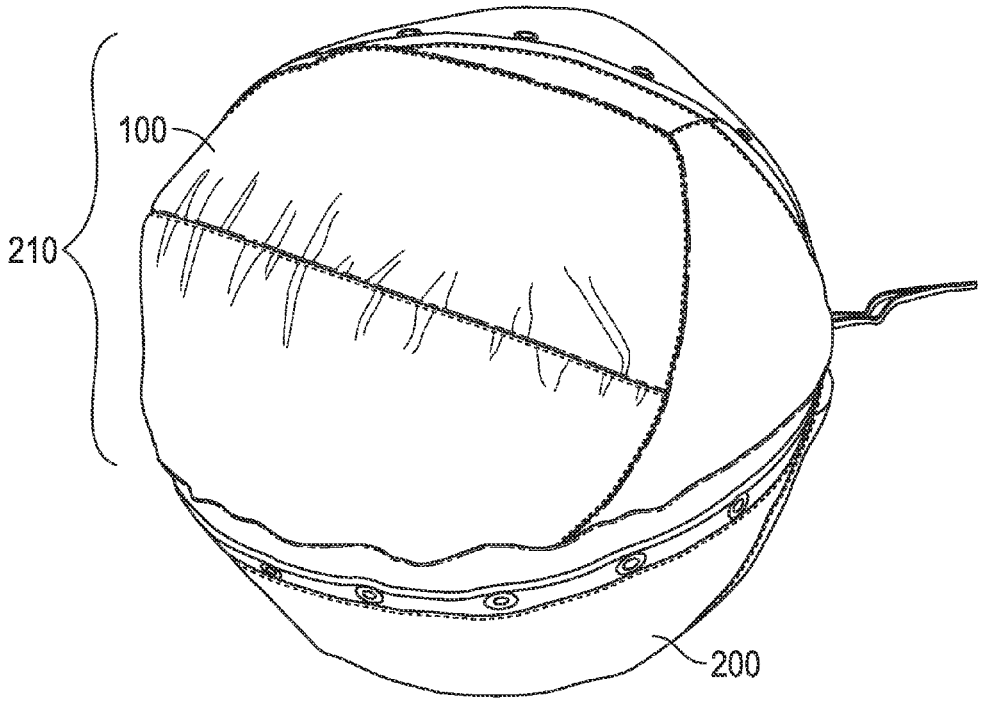
FIG. 4 is an illustration of the medicine ball cover as it opens to surround the medicine ball, according to one embodiment of the invention.
Figure 5:
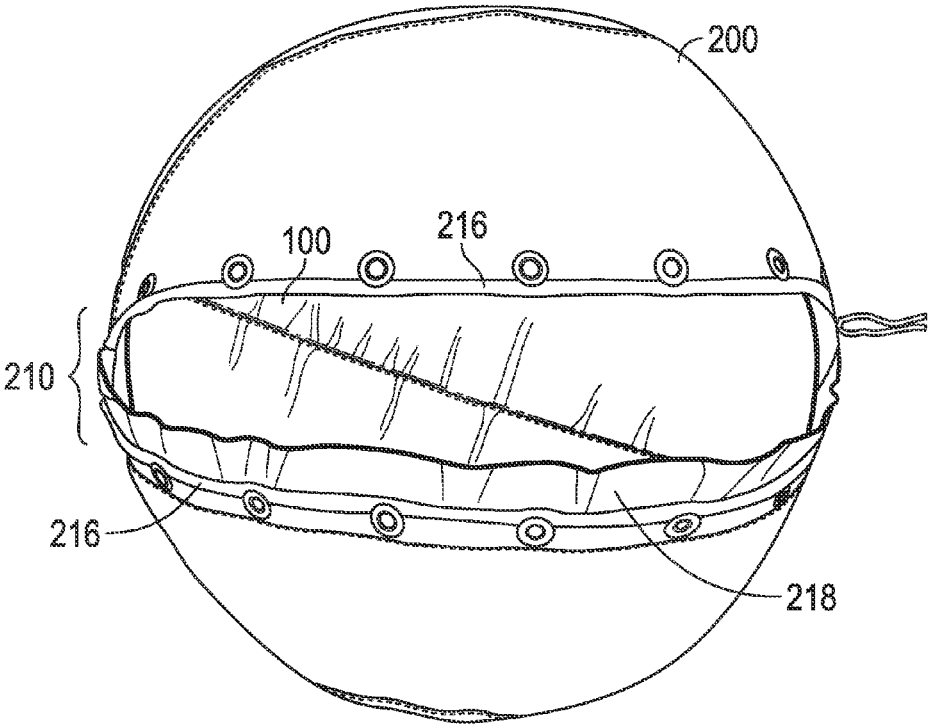
FIG. 5 is an illustration of the medicine ball cover after it has substantially surrounded the medicine ball but before the opening has been cinched together.

FIG. 4 is an illustration of the ball cover 200 as it is being positioned over the medicine ball 100. As shown in FIG. 4, the size of the opening 210 is large enough to fit the medicine ball inside. FIG. 5 illustrates the ball cover 200 as it has been almost full positioned around the medicine ball 100, such as the ball cover would appear before the opening is closed by the closure mechanism. The medicine ball cover 200 is then pulled closed and laced shut by feeding rope or lacing (see, FIG. 3 214) through the grommets 212 and cinching the lace 214 tight. The laces 214 can be tied in a standard bow or knotted at the ends and then tucked inside the cover to be completely hidden.

FIG. 5 also provides an illustration of a protective layer 216 which can be attached to the edges of the opening 210 in order to prevent the ball cover material from freying or wearing down on the edges of the opening. Also illustrated in FIG. 5 is a protective flap 218 which extends into the opening 210 from one or more edges of the opening. The protective flap 218 will ensure that the entirety of the medicine ball is covered once the opening has been cinched closed, as in FIG. 3. The protective flap 218 will also protect the lacing from coming into contact with the medicine ball surface, which will prevent potential friction and wear on the lacing.

Figure 6:
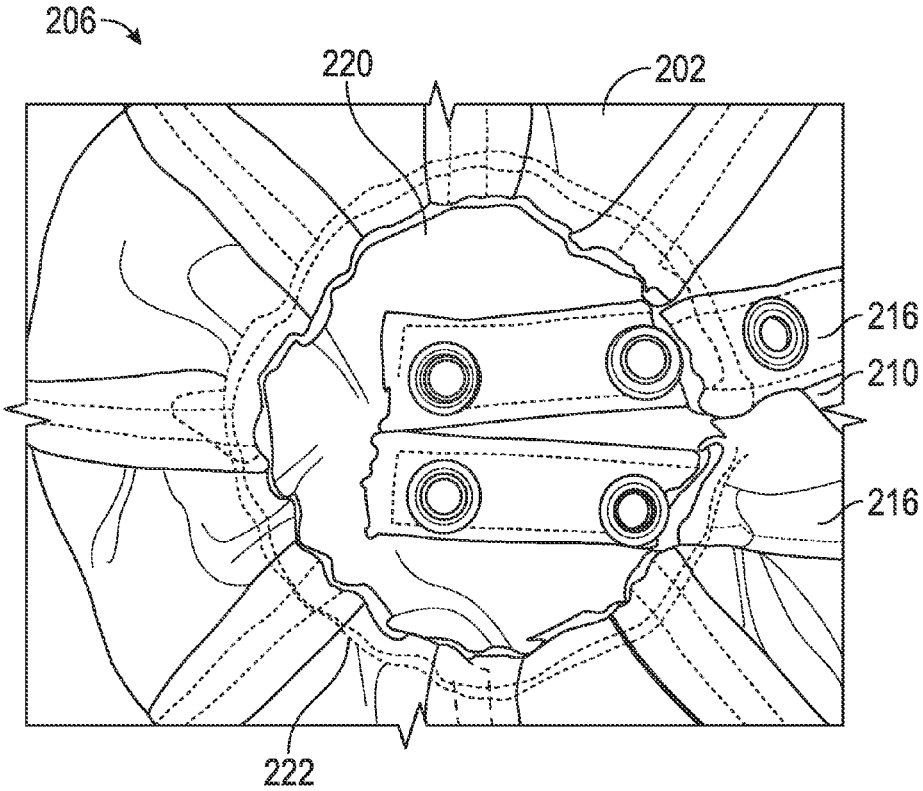
FIG. 6 is an illustration of a side portion of the medicine ball where multiple panels of the cover material and both edges of the opening intersect.

FIG. 6 illustrates an interior surface of the ball cover 200 (turned inside-out) as viewed from the first pole 206, although the second pole 208 would be identical. The pole 206 may be configured with a circular section of material 220 that is attached to each panel 202 of material through stitching, such as a lock stitch method, or by high pressure fusion. There are multiple additional methods by which the panels 202 can be joined. As is illustrated in FIG. 6, the circular section 220 may be attached by a double row of stitching 222 in order to secure each panel 202. The protective layers 216 of the opening 210 are illustrated herein as separate strips of material stitched to the material adjacent to the opening.

Figure 7A:
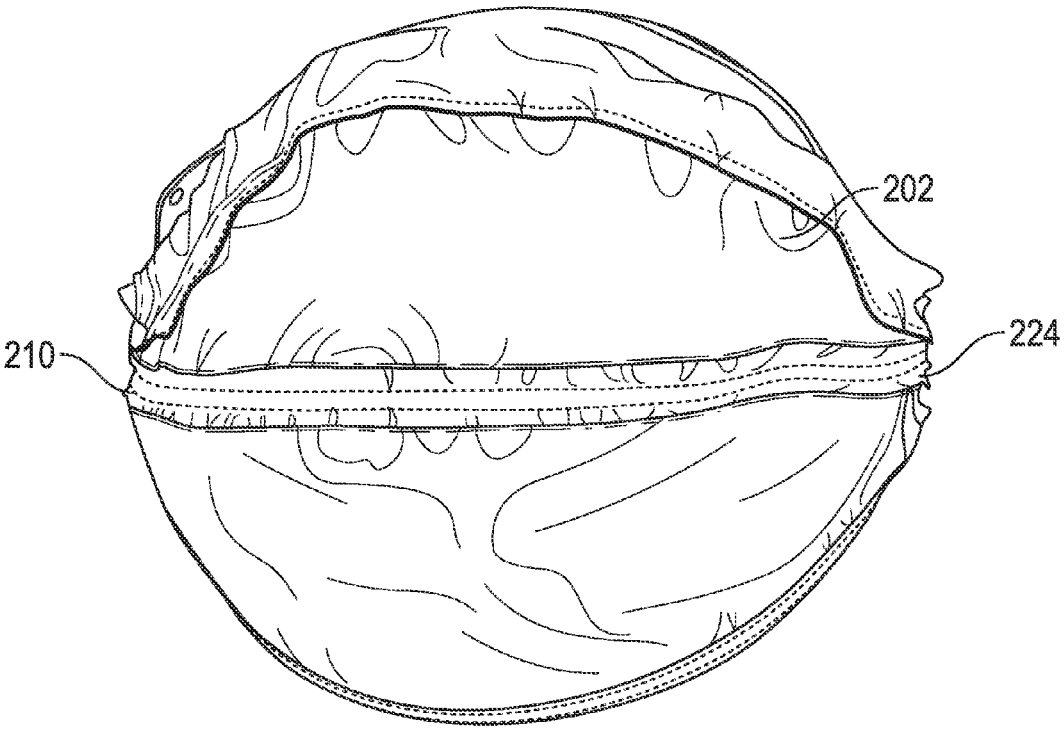
FIGS. 7A and 7B are illustrations of an inside surface of the medicine ball which illustrates a triple-stitched seam and reinforced backing which connects the panels of cover material together, according to one embodiment of the invention.
Figure 7B:
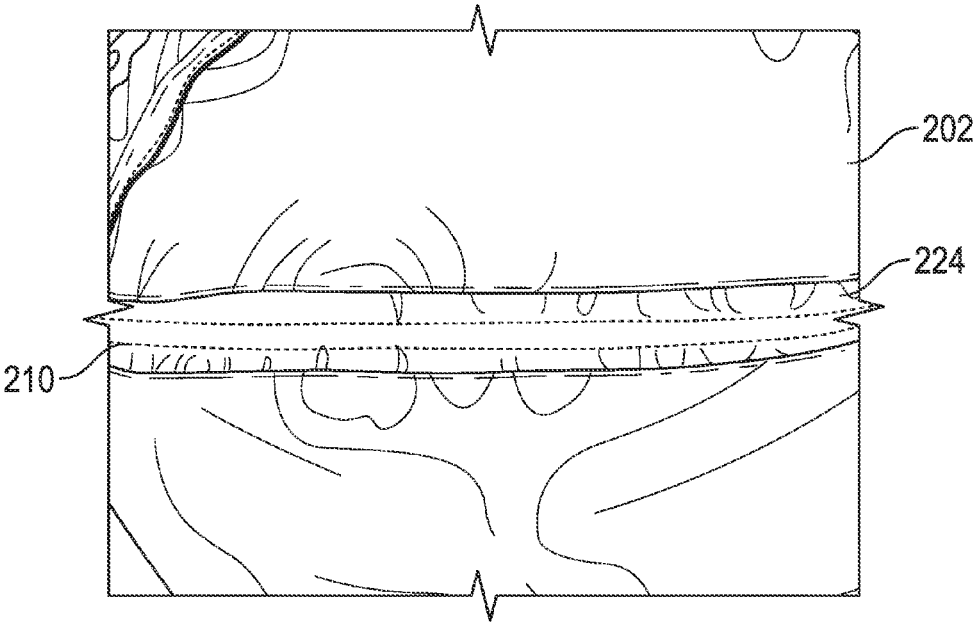

FIGS. 7A and 7B are illustrations of the inside surface of the medicine ball cover (again showing the ball cover inside-out) which illustrate a triple-stitched seam 204 and a reinforced backing 224 along each seam 204 which connects the panels 202 of cover material together (the third row of stitching, not shown, being hidden below the reinforced backing 224 and used to directly secure the panels 202 together; the reinforced backing 224 is then stitched to both panels 202.). In one embodiment, the reinforced backing 224 is a 0.75 inch nylon binding strip. The triple stitching and the reinforced backing 224 may be used to strengthen the seam 204 between the panels.

In one embodiment, the material of the ball cover may be a vinyl or PVC material, such as 18 ounce vinyl-coated polyester. The material may be mildew and UV resistant to prolong the life of the cover and prevent fading or mildew buildup on the outer surface of the ball cover as well as between the interior surface of the ball cover and the exterior surface of the ball itself. However, other materials such as leather or rubber may be used depending on the desired use for the medicine ball. The reinforced backing may be a nylon material.

In one embodiment, the ball cover may be made from eight panels of material of approximately 18.5 inches by 5.5 inches in diameter, all connected together to a four inch diameter circular section 220. In one embodiment, about nine feet of a poly-cotton string is used to stitch the panels and protective layers together. The grommets may be approximately 0.25 inches in diameter and spaced approximately 1.5 to 2.0 inches apart, and in one embodiment, about twenty-six grommets are used. The grommets may be positioned along that edge of the opening approximately 0.25 to 0.5 inches from the edge, although this distance can be increased in order to provide more control over how tight the ball cover fits on the ball.

In one embodiment, the opening 210 is approximately 24 inches in diameter from the first pole 206 to the second pole 208. The opening 210 may open to a width of approximately 20 inches at it's widest point, so that it can easily cover a traditional medicine ball with a circumference of about 45 inches.

While various embodiments have been described above, it should be understood that they have been presented by way of example only, and not of limitation. The breadth and scope should not be limited by any of the above-described exemplary embodiments. Where this document refers to technologies that would be apparent or known to one of ordinary skill in the art, such technologies encompass those apparent or known to the skilled artisan now or at any time in the future. In addition, the described embodiments are not restricted to the illustrated example architectures or configurations, but the desired features can be implemented using a variety of alternative architectures and configurations. As will become apparent to one of ordinary skill in the art after reading this document, the illustrated embodiments and their various alternatives can be implemented without confinement to the illustrated example. One of ordinary skill in the art would also understand how alternative functional, logical or physical partitioning and configurations could be utilized to implement the desired features of the described embodiments.

Furthermore, although items, elements or components may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

What is claimed is:

1. A removable medicine ball cover, comprising:

a spherical-shaped covering configured to enclose a spherical medicine ball without any fasteners between an inner surface of the covering and an outer surface of the medicine ball, the covering comprising a plurality of panels of material, the spherical-shaped covering having opposite first and second poles at which the panels of material meet, and defining an internal cavity of dimensions substantially equal to the spherical dimension of a medicine ball to be enclosed within the spherical-shaped cavity, whereby the spherical-shaped covering is a tight frictional fit over the medicine ball;

an opening disposed within the spherical-shaped covering, wherein the opening is configured to extend over a medicine ball to be enclosed within the spherical-shaped covering, the opening extending in a circumferential path from the first pole to the second pole and having a first edge and a second edge opposite the first edge;

a closure mechanism which is configured to draw the first and second edges together and close the opening when the medicine ball cover substantially covers the medicine ball; and wherein the cover is made of four or more panels, each panel comprising a single layer of a mildew and UV resistant material, each panel has opposite edges extending between the first and second poles, one pair of panels have adjacent edges which are separate from one another and comprise the first and second edges of the opening, and adjacent edges of the panels apart from the first and second edges of the opening are stitched or bonded together at seams to form the spherical shape.

2. The removable medicine ball cover of claim 1, wherein the panels of material are vinyl-coated polyester.

3. The removable medicine ball cover of claim 1, wherein the closure mechanism comprises a first row of grommets extending along the first edge of the opening and a second row of grommets extending along the second edge of the opening and a lacing material which extends through the openings in the first and second rows of grommets to cinch the first and second edges of the opening together.

4. The removable medicine ball cover of claim 3, further comprising a protective, elongate flap of material which extends from the first edge into the opening along the length of the opening to prevent contact between the medicine ball and the lacing material.

5. A method of attaching a medicine ball cover to a medicine ball, comprising:

engaging an elongate opening extending generally between opposite poles of a medicine ball cover of spherical shape defining an internal cavity of predetermined spherical dimensions over a medicine ball of corresponding spherical shape and substantially equal spherical dimensions to the cavity;

extending the opening over the medicine ball until the medicine ball cover encloses the medicine ball apart from the opening;

lacing rope through grommets extending along opposite first and second edges of the opening in the medicine ball cover;

cinching the rope tight to close the opening and fit the medicine ball cover tightly around the medicine ball, wherein the medicine ball cover is a tight frictional fit over the medicine ball without any fastener between the medicine ball cover and medicine ball;

securing the rope by knotting ends of the rope and tucking them in;

wherein the medicine ball cover is made of four or more panels each comprising a single layer of material, the elongate opening extends between separate edges of two adjacent panels, and the panels are secured together by seams apart from the separate edges of the two adjacent panels between which the elongate opening extends.

6. The method of claim 5, wherein the panels are made of mildew and UV resistant material.

* * * * *